US012135185B2

(12) United States Patent
Wutte

(10) Patent No.: US 12,135,185 B2
(45) Date of Patent: Nov. 5, 2024

(54) SECONDARY HANDGUARD MOUNT

(71) Applicant: GLOCK TECHNOLOGY GMBH, Ferlach (AT)

(72) Inventor: Andreas Wutte, Ferlach (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 18/062,400

(22) Filed: Dec. 6, 2022

(65) Prior Publication Data

US 2023/0184510 A1 Jun. 15, 2023

(51) Int. Cl.
*F41C 23/16* (2006.01)

(52) U.S. Cl.
CPC ..... *F41C 23/16* (2013.01)

(58) Field of Classification Search
CPC ..... F41A 21/482; F41A 21/48; F41A 5/18; F41C 23/16; F41G 11/003
USPC ..... 42/71.01, 75.01–75.1
See application file for complete search history.

(56) References Cited

U.S. PATENT DOCUMENTS 6,895,708 B2 * 5/2005 Kim ..... F41G 11/003 42/106
7,707,762 B1 * 5/2010 Swan ..... F41C 23/16 42/105
7,770,317 B1 * 8/2010 Tankersley ..... F41C 23/16 42/71.01
8,037,633 B1 10/2011 Troy
8,234,808 B2 * 8/2012 Lewis ..... F41A 3/36 42/72
8,578,647 B2 * 11/2013 Storch ..... F41G 11/003 248/187.1
8,607,490 B1 12/2013 Zinsner
8,769,853 B1 * 7/2014 LaRue ..... F41C 23/16 42/71.01
8,931,196 B1 1/2015 LaRue
9,200,867 B1 * 12/2015 Swan ..... F41C 23/16
9,303,949 B1 * 4/2016 Oglesby ..... F41C 23/16
9,383,163 B2 * 7/2016 Kincel ..... F41C 23/16
9,464,865 B2 * 10/2016 Shea ..... F41C 23/16
(Continued)

FOREIGN PATENT DOCUMENTS

DE 102005037884 B3 1/2007
DE 102010023466 A1 12/2011
(Continued)

*Primary Examiner* — Michael D David
(74) *Attorney, Agent, or Firm* — Raven Patents, LLC; Anton E. Skaugset

(57) ABSTRACT

A device for forming a secondary mount of a handguard on a firearm, wherein it is possible to bring the upper receiver of the firearm into a partially dismantled state from the lower receiver by tilting about a front takedown pin and/or into a dismantled state by removing (a pin), there being in the mounted state an elastic clamping connection between the handguard and the upper receiver and/or a barrel mount connected to the upper receiver, which barrel mount comprises at least one clamping element and at least one abutment, and the clamping element is designed such that when the handguard is connected or removed, an elastic deformation of at least one part of the clamping element takes place, and such that, in the mounted state, there is resilient prestressed contact with the abutment and/or at least partial accommodation in the abutment.

20 Claims, 4 Drawing Sheets

(56) References Cited

U.S. PATENT DOCUMENTS

| | | | | |
|---|---|---|---|---|
| 9,476,673 | B2 | 10/2016 | Miller | |
| 9,528,793 | B1 * | 12/2016 | Oglesby | F41C 27/00 |
| 9,696,112 | B2 * | 7/2017 | Gottzmann | F41G 11/003 |
| 10,184,752 | B2 * | 1/2019 | Tubb | F41A 21/44 |
| 10,330,433 | B2 * | 6/2019 | Gottzmann | F41A 21/48 |
| 10,352,650 | B2 * | 7/2019 | Hiler, Jr. | F41A 21/482 |
| 10,401,103 | B2 * | 9/2019 | Konev | F41A 17/38 |
| 10,480,897 | B2 * | 11/2019 | Keeney | F41C 27/00 |
| 10,527,386 | B2 * | 1/2020 | Faxon | F41C 23/16 |
| 10,724,825 | B2 * | 7/2020 | Keeney | F41C 23/16 |
| 10,989,494 | B1 * | 4/2021 | Sylvester | F41A 21/482 |
| 11,656,059 | B1 * | 5/2023 | Ding | F41C 23/16 42/71.01 |
| 2006/0191183 | A1 * | 8/2006 | Griffin | F41C 23/16 42/72 |
| 2006/0207156 | A1 * | 9/2006 | Larue | F41G 11/003 42/127 |
| 2011/0061284 | A1 * | 3/2011 | Cabahug | F41C 27/00 42/84 |
| 2011/0119981 | A1 * | 5/2011 | Larue | F41G 11/003 42/71.01 |
| 2011/0192066 | A1 * | 8/2011 | Kimmel | F41C 23/16 42/71.01 |
| 2012/0042557 | A1 * | 2/2012 | Gomez | F41C 23/16 42/90 |
| 2012/0198990 | A1 | 8/2012 | Brittin | |
| 2013/0036650 | A1 * | 2/2013 | Larue | F41G 11/003 42/148 |
| 2013/0333263 | A1 * | 12/2013 | Hovey | F41C 23/16 42/72 |
| 2014/0076147 | A1 * | 3/2014 | Larue | F41A 5/18 42/16 |
| 2014/0076148 | A1 * | 3/2014 | Larue | F41A 3/64 42/16 |
| 2017/0059273 | A1 | 3/2017 | Geissele | |
| 2022/0341696 | A1 * | 10/2022 | Wutte | F41A 21/481 |

FOREIGN PATENT DOCUMENTS

| | | | |
|---|---|---|---|
| DE | 102013008241 | A1 | 11/2014 |
| EP | 3835708 | A1 | 6/2021 |
| EP | 3967964 | A1 | 3/2022 |
| WO | 2013010515 | A1 | 1/2013 |
| WO | 2021063891 | A1 | 4/2021 |
| WO | 2021121877 | A1 | 6/2021 |

* cited by examiner

Fig. 7A VII-VII'

SECONDARY HANDGUARD MOUNT

TECHNICAL FIELD

The present disclosure relates generally to firearms, and more specifically relates to devices for the secondary mount of a handguard on a receiver or on a barrel clamp or barrel mount, mounted on a receiver, of a firearm.

BACKGROUND

Firearms having a multi-part receiver have been known for a long time. Examples include the types M4/M16/AR15 or H&K G3 and the derivatives thereof. In these firearms, the upper receiver part is connected to the lower receiver part by means of pins which extend normally with respect to the weapon median plane. The upper receiver part and the lower receiver part are inserted into one another during assembly; corresponding holes are provided in the two parts, so that a front pin (also referred to as a pivot pin) and a rear pin (also referred to as a takedown pin) can be inserted, thus creating the receiver connection.

By removing the rear pin, the upper receiver part can be opened about the axis of the front pin, hence the term "pivot pin." In the open state, the breech is accessible and the firearm can be cleaned without complete dismantling. To completely dismantle the firearm, the front pin (also referred to as a pivot pin) must also be removed.

In other weapon models that have only a takedown pin—since the upper and lower receivers can be connected to one another via a form-fitting connection, for example—the partially dismantled state can be also achieved by partially pushing out the takedown pin and the dismantled state can be achieved by completely removing the takedown pin.

A handguard is often formed on the upper or lower receiver, which handguard protects the user from direct contact with the barrel. The handguard can be formed integrally on the upper receiver, but in many firearms it is a separate component, which means that a connection to the weapon receiver is required. This connection is also realized in most cases by a detachable connection by means of screws or pins.

Cases are also known in which the handguard is simultaneously fastened to the upper receiver by the pivot pin, as is known, for example, from DE 102013008241 A1. The same inventor disclosed a handguard with integrated wings, formed loop-like, on both sides of the handguard. They encompass the barrel mount and are used to cooperate with a pin through the holes of the loops and corresponding holes in the barrel mount in order to mount the handguard.

A large number of modifications are known to a person skilled in the art which describe a connection between the handguard and the weapon receiver. At this point, reference is made by way of example to some documents, such as those that disclose one or more transverse pins or screws (US 2017059273 A1, U.S. Pat. No. 8,037,633 B1) for securing the handguard. Alternatively, the handguard can be connected to the upper receiver by means of a wedge joint (U.S. Pat. No. 9,476,673 B2) or by means of clamps arranged on the outside of the handguard (e.g. U.S. Pat. No. 8,931,196 A1, U.S. Pat. No. 8,607,490 A1).

Very often, the handguard is connected indirectly to a barrel clamp, also referred to as a barrel mount, which is mounted on the upper receiver. This is most notably seen on firearms of the AR-15 platform, where a barrel nut is used to secure the barrel relative to the upper receiver. The handguard is occasionally clamped non-elastically (e.g. EP 3835708 A1, WO 2013010515 A1) on or screwed (DE 102005037884 B3) to this barrel nut.

US 2012/0198990 A1 discloses a handguard system with screws which fasten its detachable parts, a leaf spring within the handguard clamps a cleaning rod and stabilizes the position of the handguard by providing an upward biasing force onto the bottom exterior surface of the barrel.

Regardless of whether they describe firearms with or without a direct connection of the handguard to the upper receiver, each of the examples mentioned in the prior art have in common that the handguard is "folded down" with the upper receiver when the firearm is partially dismantled. In cases in which the upper receiver is to be separated from the lower receiver for complete dismantling (dismantled state), the separately formed connection between the handguard and the upper receiver often has to be released first.

Releasing the handguard from the barrel clamp (e.g. barrel nut) or the upper receiver can often only be carried out using a tool, which on the one hand makes handling in the field more difficult and also means greater expenditure of time. On the other hand, variants that connect the handguard to the upper receiver by means of a pivot pin have the disadvantage that the handguard is simultaneously detached from the upper receiver when the pivot pin is removed, so that the user suddenly has several loose components in their hands. Under certain circumstances, this can lead to the handguard unintentionally falling to the ground and to damage thereto or to various attachments, such as tactical lights, laser sights, or the like.

At this point, reference is explicitly made to the content of US 2017059273 A1, U.S. Pat. No. 8,037,633 B1, U.S. Pat. No. 9,476,673 B2, U.S. Pat. No. 8,931,196 A1, U.S. Pat. No. 8,607,490 A1, US 2012/0198990 A1, EP 3835708 A1, EP 3 967 964 A1, DE 102005037884 B3, DE 102010023466 A1, DE 102013008241 A, WO 2013010515 A1, WO 2021063891 A1 and WO 2021121877 A1, which are hereby incorporated by reference. That is, this content is made part of the present description by reference, for the jurisdictions in which this is possible.

There is therefore a need for a secondary handguard mount that avoids the problems mentioned above even when releasing the handguard mount known from the prior art, which shall be referred to as "primary" handguard mounts, in contrast to the secondary handguard mounts presented in the present disclosure.

SUMMARY

The present disclosure is directed to secondary handguard mounts for firearms, in particular where the firearm includes an upper receiver that can be brought into a partially dismantled state from a lower receiver by tilting about a front takedown pin, and/or brought into a dismantled state by removing a pin.

In one example, a device for forming a secondary mount of a handguard on a firearm includes a clamping connector having at least one clamping element and at least one abutment, where the clamping element is configured such that when connecting or removing the handguard, an elastic deformation of at least one part of the clamping element can take place relative to a rest position, and when in the mounted state, there is resiliently prestressed contact with the abutment and/or at least partial accommodation in the abutment, so that when in the mounted state, a resilient clamping connection is formed between the handguard and the upper receiver and/or between the handguard and a barrel mount connected to the upper receiver.

The features, functions and advantages discussed herein can be achieved independently in various embodiments of the present disclosure or may be combined in yet other embodiments, further details of which can be seen with reference to the following description and drawings below.

BRIEF DESCRIPTION OF THE DRAWINGS

The secondary handguard mounts of the present disclosure are explained in greater detail with reference to the drawings, in which, purely schematically:

FIGS. 7A and 7B provide plan views of the sectional plane VII-VII' as indicated in FIG. 6A in a partially dismantled state (FIG. 7A) and in an assembled state (FIG. 7B);

DETAILED DESCRIPTION

The secondary handguard mounts of the present disclosure are most clearly applicable to long guns, such as for example rifles, carbines, and shotguns, but may be used in conjunction with any firearm having an appropriate multi-part receiver.

Figure 1:
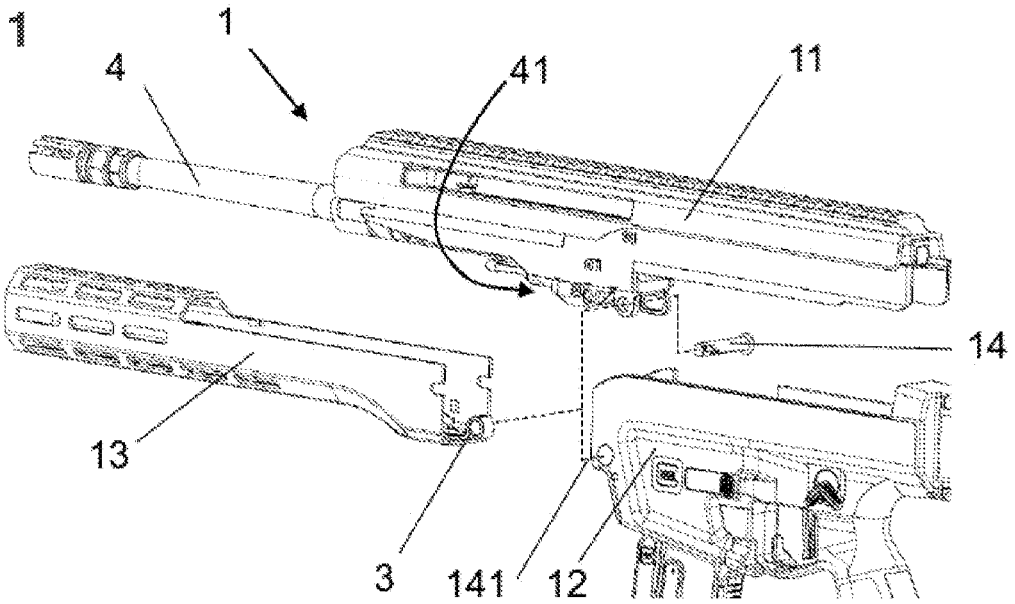
FIG. 1 is an exploded perspective view of a rifle.

FIG. 1 shows an example of a firearm 1, a rifle, in an exploded view of the most important components thereof. The barrel 4 is mounted in the upper receiver 11 by means of the barrel mount 41 thereof; a lower receiver 12 is shown in part with the essential elements thereof, with the grip and an inserted magazine being clearly visible; and the handguard 13 is shown below the barrel 4 and in front of the lower receiver 12.

Figure 5A:
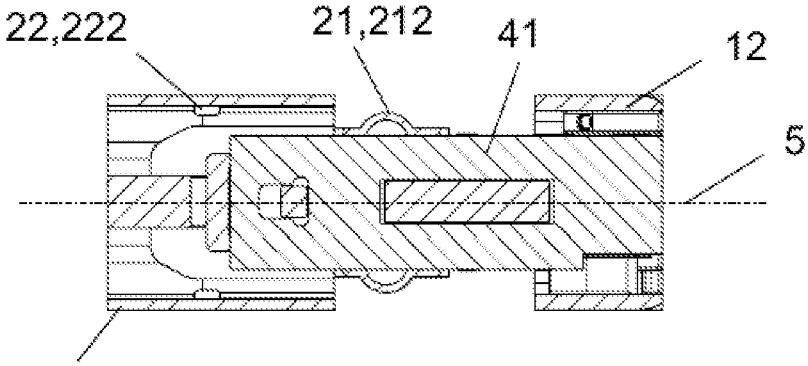
FIGS. 5A and 5B provide plan views of the sectional plane V-V' as indicated in FIGS. 2A and 2B in a partially dismantled state (FIG. 5A) and in an assembled state (FIG. 5B)
Figure 5B:
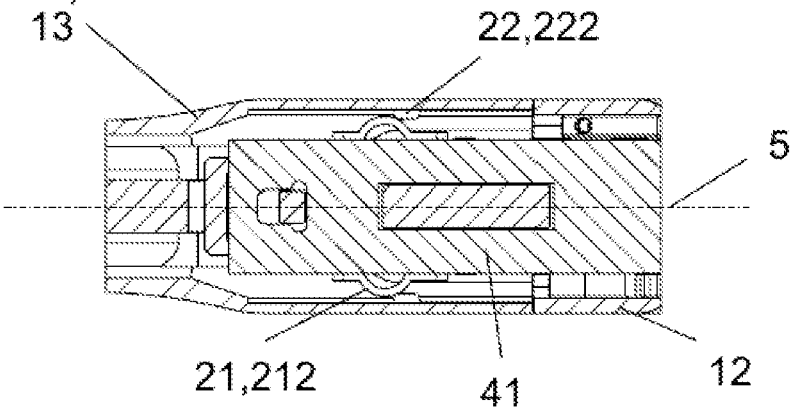

The central lines of the various circular cavities of the individual components are indicated by dashed lines that, upon assembly, align with a takedown pin 14 inserted into the circular cavities and that extends normal to the weapon median plane (see FIGS. 5A and 5B), which, cum grano salis, also forms a symmetry plane of the weapon.

In the variant shown, which has only one of the two pins mentioned at the outset, namely the front twisting pin, the takedown pin 14 can be pulled only slightly out of its holding position for partial dismantling, so that it can be held in the upper receiver 11 in only one of the two retaining openings formed there. This retaining opening is designed as a slot having a longitudinal extension parallel to the barrel axis 9 and allows the upper receiver 11, together with the barrel 4 and the handguard 13, to be pulled out of the lower receiver 12 slightly in the direction of the barrel axis 9, so that a holder formed at the rear end of the upper receiver 11 can be removed from an enclosure formed on the lower receiver 12, and then the parts pushed forward can be pivoted about the takedown pin 14. With the final removal of the takedown pin 14, the components mentioned can be separated from one another substantially without resistance, unless the secondary handguard mount according to the present disclosure is provided.

A detailed description of such a connection between the upper and lower receivers by means of such a pin guide can be found in EP20195503.6, filed by the present applicant with the EPO on 2020 Sep. 10 and published as EP 3 967 964 A1 on Mar. 16, 2022. In order to comply with the requirement of conciseness of the present application, explicit reference is made at this point to the content of this document.

Figure 2A:
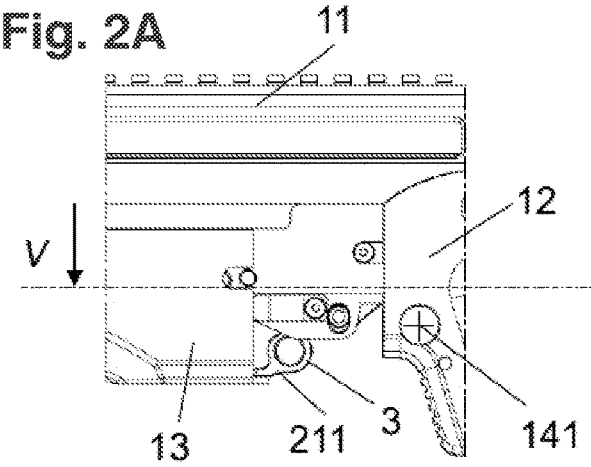
FIGS. 2A and 2B show a section of a side view of the rifle of FIG. 1 in a partially dismantled state (FIG. 2A) and in an assembled state (FIG. 2B)
Figure 2B:
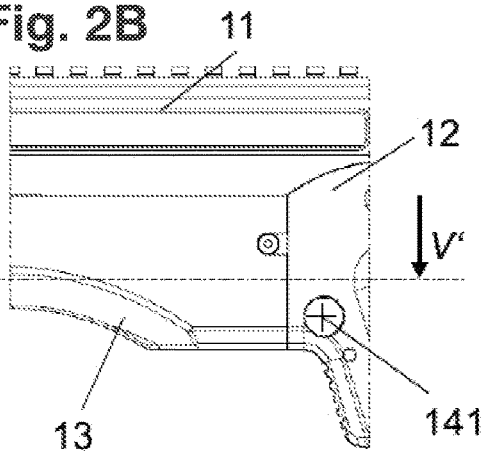

FIGS. 2A and 2B show the situation when assembling the firearm 1 shown in FIG. 1 in more detail by way of example: In the lower receiver 12, the pivot axis 141, which is stationary with respect to the lower receiver, is indicated separately. The upper receiver 11 is initially brought into the end position shown in FIG. 2A in the barrel direction 91 at the start of assembly. In the course of this movement, among other things, the holder of the upper receiver also moves into the enclosure of the lower receiver, as can be derived from FIG. 1 and is explained in more detail in the above mentioned EP 3 967 964 A1. According to the present disclosure the handguard 13, at the same time as the upper receiver 11 or, as shown in FIG. 2, as a separate step, the handguard 13 is mounted on the upper receiver 11 by means of a clamping connection for forming a secondary handguard mount. In this case, an attachment element 3 acting as a clamping element 21 is elastically deflected downward when connected. Due to the attachment element 3 mounted on the handguard 13 sliding past the barrel mount 41 (compare the sectional views in FIG. 3 corresponding to FIG. 2), until it reaches the end position of the handguard 13, as shown in FIG. 2B, the clamping element 21 with a pawl element 212 designed as a hole also reaches a flush position with the abutment 22 designed as a pawl protrusion 222.

FIG. 3 thus shows this situation in a section in the weapon median plane 5; the deflection of the clamping element 21 of the attachment element 3 can clearly be seen, which deflection exerts an upward prestress in the direction of the abutment 22 through the biasing element 211 designed as a lever arm. In the embodiment shown, the pawl protrusion 222 is designed to protrude downward in the center of the weapon median plane in the transverse direction.

Without reference signs, in FIG. 2 at the rear end of the handguard 13, approximately in the region of the barrel axis 9, there are cavities which are clearly visible in FIG. 1 and which interact with lateral projections of the barrel mount 41 in the final assembly state and can thus be an additional positioning aid for the handguard 13.

Figure 3A:
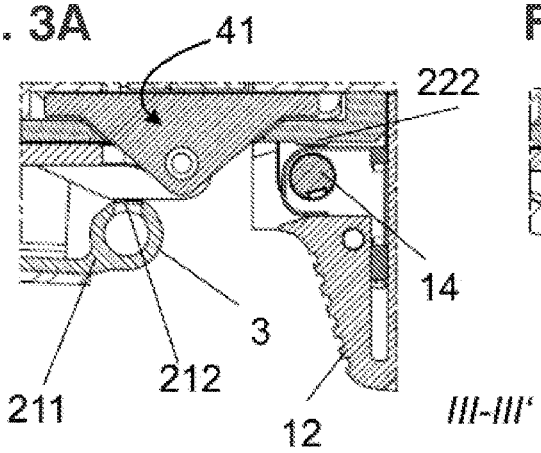
FIGS. 3A and 3B correspond to enlarged sectional views of the situation of FIGS. 2A and 2B, respectively.
Figure 3B:
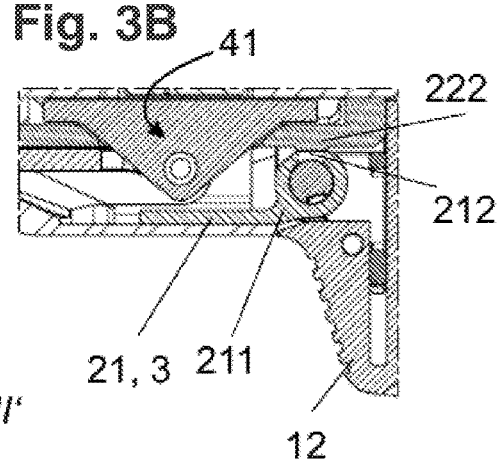

In addition, the takedown pin 14 can also be seen in FIG. 3A, which is shown as a shaded area for the sake of clarity. The takedown pin 14 is in the dismantling position, i.e. at least partially pulled out laterally from the lower receiver 12, as a result of which the handguard 13 can be pushed backward into the end position in FIG. 3B. As can easily be imagined, the handguard 13 is thus additionally fixed in its position by the takedown pin 14 when said pin is pushed in again along the pivot axis 141 to fix the upper receiver 11 to the lower receiver 12. This substantially corresponds to a "primary handguard lock."

Figure 4A:
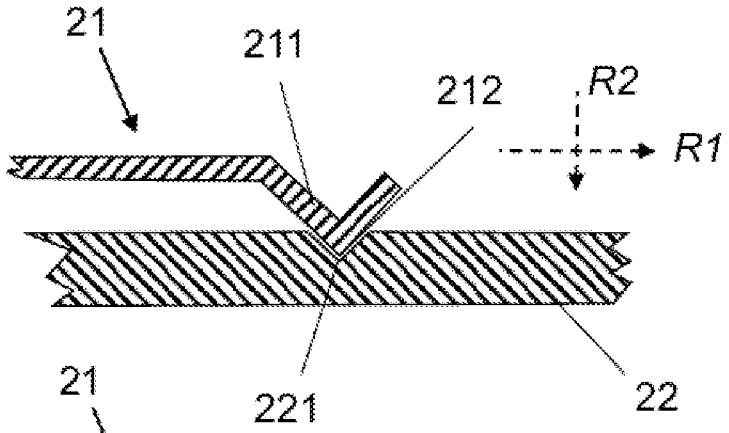
FIGS. 4A and 4B show the operating principle of a clamping connector that includes a clamping element and an abutment.
Figure 4B:
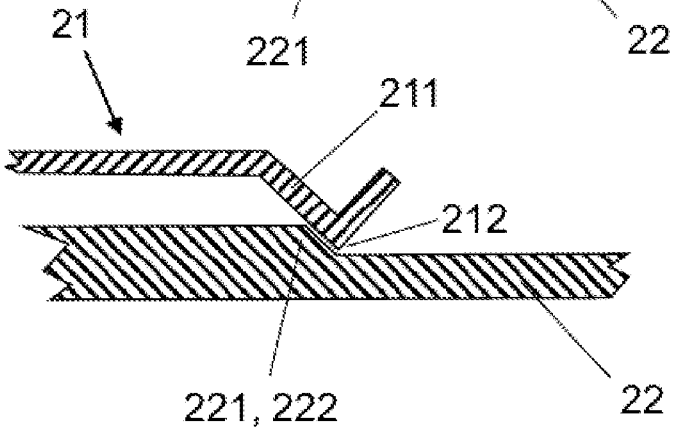

FIGS. 4A and 4B show two exemplary embodiments of the secondary handguard lock according to the present disclosure in an extremely schematic manner in order to fundamentally illustrate the operating principle of the resilient clamping connector. These are intended only to explain the concept and the interpretation of terms such as pawl recess 221, pawl protrusion 222, pawl element 212 and the like.

It can be advantageous if the clamping element 21 comprises an elastically deformable biasing element 211 and a pawl element 212 designed for at least partial accommodation in the abutment 22 or at least partial contact with the abutment 22.

Although multi-part arrangements can be used by a person skilled in the art in view of the spatial situation, it may be highly advantageous if the biasing element 211 and the pawl element 212 are designed in one piece. That is, that the biasing element 211 and the pawl element 212 are integrally formed.

In principle, it should be noted that the abutment 22 can define a pawl recess 221 for accommodating and/or contacting the clamping element 21, in particular any pawl element 212 that may be formed. Notches or beads, for example, which can be provided relatively easily, are conceivable as the pawl recess 221, which allow contacting of the clamping element 21 and are advantageous in terms of production technology. Alternatively or additionally, the abutment 22 can have a pawl protrusion 222 for at least partially contacting the clamping element 21, in particular the pawl element 212 that may be formed, in the mounted state.

The embodiment according to FIG. 4A is a fixation that is resiliently prestressed in the direction R2 and thus also acts resiliently along the direction of insertion R1. In order to form the secondary locking of the handguard 13 on the upper receiver 11 and/or a barrel mount 41 connected thereto, it is therefore necessary during assembly to elastically deform the biasing element 211 counter to direction R2. The resilient prestress is maintained when the latching position is reached, i.e. the position in which the pawl recess 221 of the abutment 22 coincides with the pawl element 212 of the clamping element 21. It is thus illustrated in a relatively simple manner how a position in both directions R1 and R2 can be specified which depends only on the shape of the abutment 22 or of the clamping element 21, shown by way of example by its exemplary pairing of the pawl element 212 and the pawl recess 221.

The variant according to FIG. 4B also allows the clamping element 21 to be displaced in the insertion direction R1 by elastic deflection of the biasing element 211 or the pawl element 212. If the end position is reached in this case, the clamping element 21 can in turn interact with the abutment 22. In this embodiment, however, the shoulder shown can be understood both as a pawl recess 221 open on one side and as a pawl protrusion 222 which interacts with the pawl element 212 of the clamping element 21. By elastically deforming the clamping element 21, the resilient clamping connection can be overcome when the handguard 13 (not shown) is pulled off counter to the direction of insertion R1. The deformation of the clamping element 21 or of the biasing element 211 thus takes place in order to overcome the secondary handguard lock.

In the two figures, a small gap was left between the pawl element 212 and the abutment 22; this does not correspond to reality, but serves only to better separate the elements from a visual point of view.

The highly simplified illustration in FIG. 4 should also be used to note that an interchanged arrangement of the active components, i.e. the clamping element 21 and the abutment 22, on the handguard 13 or the upper receiver 11 and/or the barrel mount 41 fall within the scope of the present disclosure.

As an example of such a reversal of the action of the resilient clamping connection, FIG. 5 shows the section along the line V-V' in FIG. 2, i.e. a plan view through the firearm analogous to the two positions as shown in FIG. 2. In FIG. 5, however, an additional embodiment of a secondary handguard mount according to the present disclosure is shown schematically.

It can be seen from these two schematic figures that by resiliently pushing over the pawl protrusions 222, which are arranged to the left and right of the weapon median plane 5 on the lower receiver 12 on the handguard 13, these protrusions engage with the clamping element 21 or the pawl element 212. As can be seen in particular from FIG. 5B, and as a result of the oblique contact of the pawl elements 212 with the pawl protrusions 222 as a result of the contact of the end faces in a plane at least approximately normal to the barrel axis 9, a "closing" force in the connection direction, parallel to the barrel axis 9, is built up, which closing force cannot be overcome without overcoming the resilient holding force normal to the weapon median plane 5, so that the two components are held together independently of other connections.

In this embodiment, the abutment 22 is thus formed on the handguard 13, while the clamping element is formed on the barrel mount 41. In the exemplary representation, the lower receiver 12 can also be seen, which ends flush with the handguard 13 in the view of FIG. 5B. This example makes it easy to understand that the clamping element 21 can be fixedly, preferably integrally, formed on the upper receiver 11 or the barrel mount 41 and the abutment 22 can be fixedly formed on the handguard 13.

A few further embodiments are intended to further develop the concept according to the present disclosure, especially with regard to the fact that the clamping element 21 can be fixedly, preferably integrally, formed on the handguard 13 and the abutment 22 can be fixedly formed on the upper receiver 11 or the barrel mount 41.

Figure 6A:
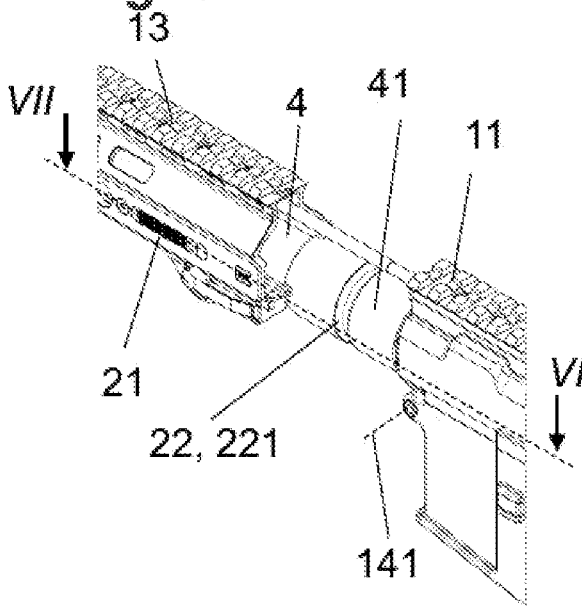
FIGS. 6A and 6B provide exploded perspective views of an AR-15-style rifle in a partially dismantled state (FIG. 6A) and in an assembled state (FIG. 6B)
Figure 6B:
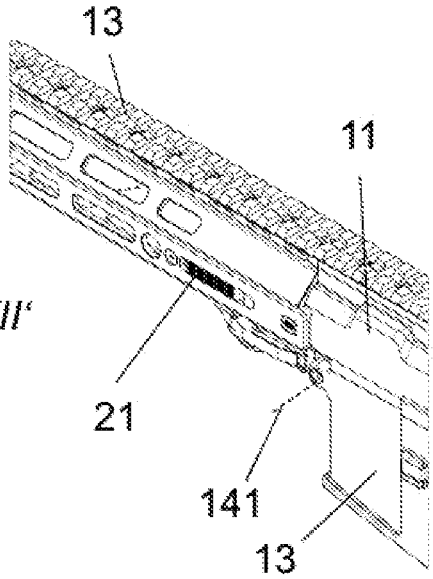
Figure 6B:
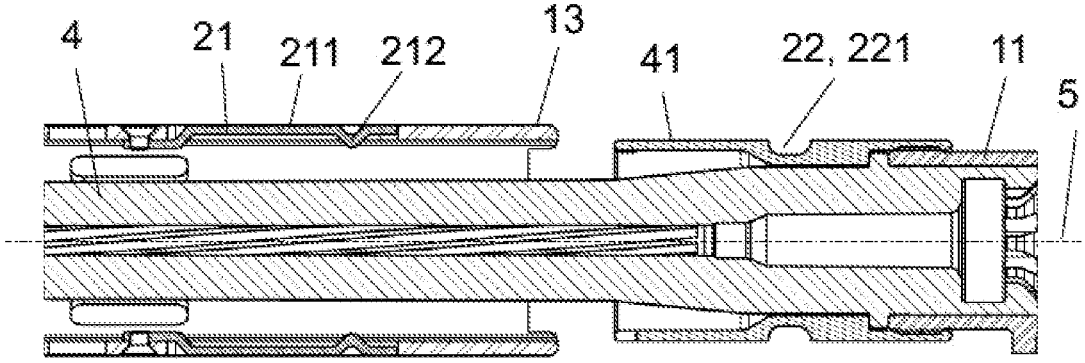
Figure 7B:
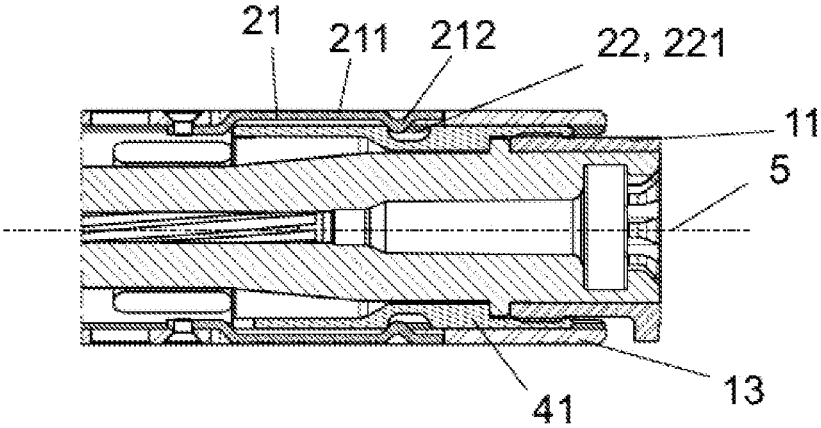

FIGS. 6 and 7 are examples of how the secondary handguard mount may be formed on the barrel mount 41 of an AR-15-style firearm. The barrel mount 41 is often designed as a barrel extension in such firearms and fixes the barrel 4 to the upper receiver 11, as can be seen very clearly from FIG. 6 in combination with FIG. 7.

FIG. 6A shows a handguard 13 before it is assembled with the upper receiver 11. In this example, the primary handguard mount is carried out by a mounting mechanism on the barrel extension, which mechanism is explained in more detail in WO2021121877A1. WO2021121877A1 explains in detail the primary mount to which the present disclosure adds the secondary mount. However, an additional clamping element 21 can also be seen in FIG. 6A, which is shown in more detail in FIG. 7 in the plan view of the handgun on the line VII-VII' from FIG. 6A. The clamping element 21 is mounted on the handguard 13 by means of a screw connection and can be elastically deflected outwards by the biasing element 211, i.e. substantially in the transverse direction in this example, in order to interact with an annular groove attached to the barrel extension (here also referred to as the barrel mount 41). In this case, the annular groove represents a pawl recess 221 and thus the barrel mount 41 also acts as an abutment 22.

As explained at the outset, this relatively simple measure allows the handguard 13 to be clamped resiliently to the upper receiver 11 or to the barrel mount 41 mounted thereon even after the primary handguard mount has been released. In the specific example, a mounting portion is formed on a second end portion of the clamping element 21 or on the biasing element 211, while a pawl element 212 in the form of an offset is formed on the first end portion. The assembled state can be seen quite easily from the combination of FIG. 6B and FIG. 7B.

In a further embodiment, the clamping connection formed by the clamping connector of the present disclosure can also be formed by the interaction of components which have a different primary function.

Figure 8A:
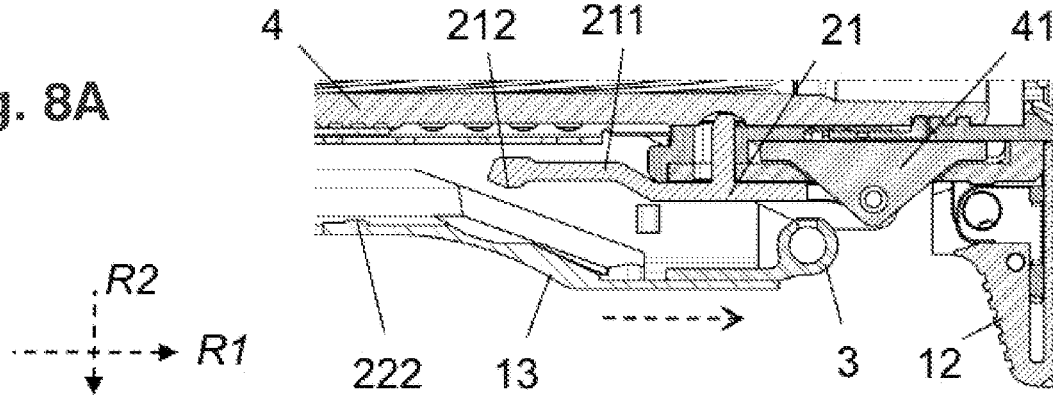
FIGS. 8A and 8B provide sectional views of the side view of a rifle as indicated in FIGS. 1 to 3 in a partially dismantled state (FIG. 8A) and in an assembled state (FIG. 8B)

FIG. 8 schematically shows a barrel mount 41, as is known, inter alia, from WO2021063891A1 and to which explicit reference is made at this point. A closed barrel clamp lever 42 is shown, which has an additional function for the formation of the secondary handguard mount according to the present disclosure. In this case, the barrel clamp lever 42 can function as a one-sided biasing element 211 due to its mounting or support in the barrel mount 41, as can be seen clearly from FIG. 8A. The offset barrel clamp lever thus acts as a biasing element 211 and has a pawl element 212 on the second end portion thereof. On the inside of the handguard 13 a pawl protrusion 222 can be seen.

Figure 8B:
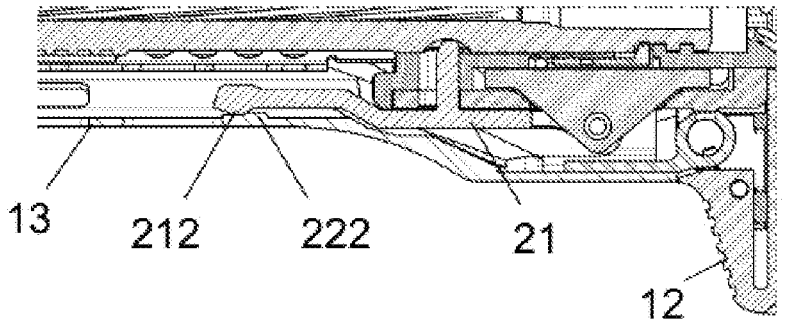

By pushing the handguard 13, together with the upper receiver 11 or lower receiver 12, into the insert, as shown in FIG. 8B, the pawl element 212 is elastically deflected via the pawl protrusion 222 and comes to rest behind said protrusion, as viewed in the barrel direction. In this way, analogously to the previous description, a resilient clamping connection is formed in the direction of insertion R1 or normal thereto in direction R2.

Figure 9A:
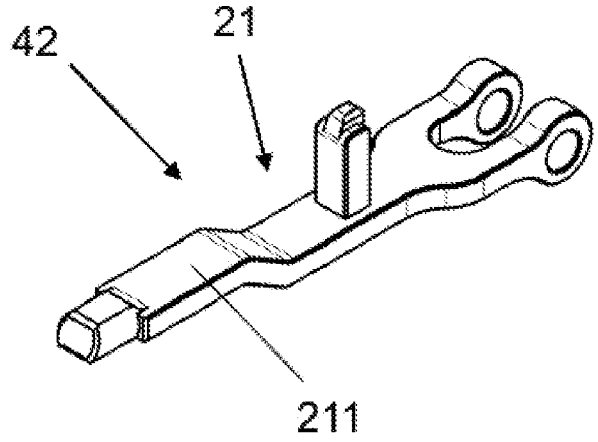
FIGS. 9A and 9B provide a perspective view (FIG. 9A) and a side view (FIG. 9B) of an exemplary barrel clamp lever.
Figure 9B:
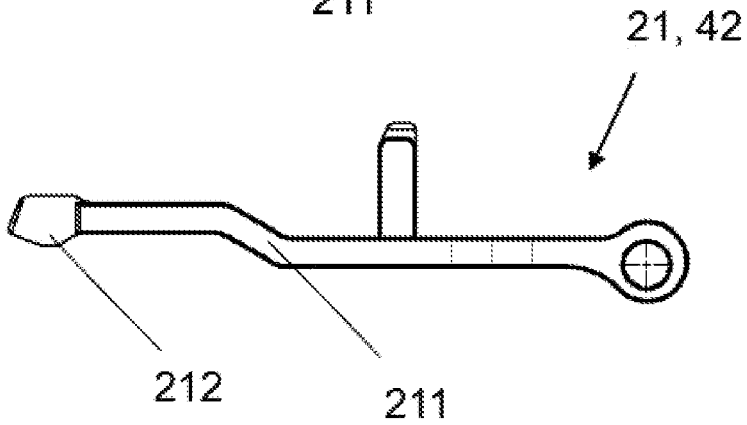

In order to illustrate this particular embodiment, reference is made to the combination with FIG. 9; where the clamping element 21, designed as a barrel clamp lever 42, is shown in a perspective view (FIG. 9A) and in a side view (FIG. 9B). In this advantageous way, one or more additional components can be dispensed with, since in this example the barrel clamp lever 42 is designed to be sufficiently elastically deformable and thus at the same time forms the clamping element 21 for interacting with the abutment 22 integrally formed on the handguard 13.

It can also be seen from the example in FIG. 8 in combination with FIGS. 2 and 3 that the clamping element 21 can be designed as an eyelet-shaped attachment element 3 for accommodating the takedown pin 14 and a pawl protrusion 222 is formed on the upper receiver 11 or the barrel mount 41. The eyelet shape of the attachment element 3 also allows the clamping element 21 to contact the outside of the eyelet in the installed state, which means that a further dual function of components can be utilized. In this way, a primary mount of the handguard 13 and, with sufficient tolerances, also a secondary handguard mount can be formed.

It has also proven to be advantageous if the attachment element 3 has an additional cavity on the side thereof facing the barrel mount 41 for at least partially contacting or accommodating the abutment 22, as a result of which the handguard 13 is positioned with great repetition accuracy at a defined position of the clamping element 21 relative to the abutment 22.

As explained above with reference to the examples, the clamping element 21 can be fixed relatively easily to the upper receiver 11 or the barrel mount 41 by means of screws, spring pins or the like. However, it is also possible to form the clamping element 21 by means of an integral construction, such as by protruding a biasing element 211 and/or pawl element 212 or a bead with a similar effect. This can significantly reduce the number of components required and is also intended to apply analogously to the design of the abutment 22.

Finally, it should also be noted that it has proven to be advantageous if the elastic deformation of the at least one part of the clamping element 21, in particular any pawl element 212 that may be formed, relative to its rest position in the mounted state is between 0.5 and 0.1 mm, preferably between 0.4 and 0.2 mm, in particular approximately 0.3 mm. In order to form the clamping element 21 or at least the biasing element 211, the use of spring steel has proven to be particularly favorable, since it retains the resilient prestress of the clamping element 21 quite well even during or after increased thermal stress.

In an alternative embodiment, the secondary handguard mount of the present disclosure further includes a second clamping element that is formed symmetrically relative to a weapon median plane relative to a first clamping element.

The scope of the present disclosure is not limited to the specific embodiments shown and described, but can be modified and configured in different ways by one of skill in the art. In particular, the cross-sectional shapes shown of the mentioned receiver and breech parts, pins, rails, cavities, etc. can be adapted to the given basic data, and the lengths and the positions with respect to the receiver can also be easily adapted by a person skilled in the art with knowledge of the present disclosure. In particular, equivalent designs are obvious with knowledge of this disclosure and can be readily carried out by a person skilled in the art.

It should also be noted that in the description and the claims, terms such as the "lower region" of an object refer to the lower half and in particular the lower quarter of the overall height; "lowermost region" refers to the lowermost quarter and in particular an even smaller part, while "central region" refers to the central third of the overall height. For the terms "width" or "length," this applies mutatis mutandis. All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), and for specifications such as "parallel" or "normal," this means±10°. When expressions such as "substantially constant" etc. are used, this refers to the technical possibility of deviation which is used as a basis by a person skilled in the art and not the mathematical possibility of deviation. For example, a "substantially L-shaped cross section" has two elongate surfaces, one end of each surface merging into the end of the other surface, and the longitudinal extensions of which are arranged at an angle of from 45° to 120° to one another.

All given quantities and percentages, in particular those relating to the present disclosure, insofar as they do not relate to specific examples, are understood to have a tolerance of ±10%; accordingly, for example: 11% means: from 9.9% to 12.1%. With terms such as "a solvent," the word "a" is not to be considered to represent a singular numeral, but rather is to be considered an indefinite article or pronoun, unless the context indicates otherwise.

The terms "combination" and "combinations", unless otherwise stated, mean all types of combinations, starting from two of the relevant components up to a plurality or all of such components; the term "containing" also means "consisting of."

The features and variants of the present disclosure specified in the individual embodiments and examples, in particular in the variants shown in the figures, can easily be combined with those of the other examples, embodiments and figures and in particular can be used for characterizing the invention in the claims without necessarily including the other details of the particular embodiment or of the particular example.

List of reference signs:

| | | | |
|---|---|---|---|
| 1 | Firearm | 3 | Attachment element |
| 11 | Upper receiver | 4 | Barrel |
| 12 | Lower receiver | 41 | Barrel mount |
| 13 | Handguard | 42 | Barrel clamp lever |
| 14 | Takedown pin | 5 | Weapon median plane |
| 141 | Pivot axis | 9 | Barrel axis |
| 2 | Secondary handguard mount | 91 | Barrel direction (front) |
| 21 | Clamping element | 92 | Circumferential direction |
| 211 | Biasing element | 93 | Normal direction (outwards) |
| 212 | Pawl element | | |
| 22 | Abutment | | |
| 221 | Pawl recess | | |
| 222 | Pawl protrusion | | |

The invention claimed is:

1. A device for forming a secondary handguard mount on a firearm, where the firearm comprises an upper receiver that can be brought into a partially dismantled state from a lower receiver by tilting about a front takedown pin, or brought into a dismantled state by removing a pin, the device comprising:

a clamping connector comprising at least one clamping element and at least one abutment;

wherein the clamping element is configured such that when connecting or removing the handguard, an elastic deformation of at least one part of the clamping element can take place relative to a rest position; and when in a mounted state, there is a resiliently prestressed contact with the abutment or at least a partial accommodation in the abutment;

such that when in the mounted state, there is a resilient clamping connection formed between the handguard and the upper receiver or between the handguard and a barrel mount connected to the upper receiver.

2. The secondary handguard mount according to claim 1, wherein the clamping element comprises an elastically deformable biasing element and a pawl element configured for at least partial accommodation in the abutment, or for at least partial contact with the abutment.

3. The secondary handguard mount according to claim 2, wherein the elastically deformable biasing element and the pawl element are a single piece.

4. The secondary handguard mount according to claim 3, wherein the pawl element is arranged on a first end portion of the biasing element and a second end portion of the elastically deformable biasing element is configured as a mount portion for mounting on the upper receiver or the handguard.

5. The secondary handguard mount according to claim 1, wherein the abutment defines a pawl recess for accommodating or contacting the clamping element.

6. The secondary handguard mount according to claim 5, wherein the abutment defines a pawl recess for accommodating or contacting a pawl element formed by the clamping element.

7. The secondary handguard mount according to claim 1, wherein the abutment has a pawl protrusion configured to at least partially contact the clamping element.

8. The secondary handguard mount according to claim 7, wherein the abutment has a pawl protrusion configured to at least partially contact a pawl element formed by the clamping element in the mounted state.

9. The secondary handguard mount according to claim 1, wherein the elastic deformation of the at least one part of the clamping element relative to its rest position in the mounted state is between 0.5 and 0.1 mm.

10. The secondary handguard mount according to claim 9, wherein the elastic deformation of the at least one part of the clamping element relative to its rest position in the mounted state is between 0.4 and 0.2 mm.

11. The secondary handguard mount according to claim 9, wherein the elastic deformation of the at least one part of the clamping element relative to its rest position in the mounted state is approximately 0.3 mm.

12. The secondary handguard mount according to claim 9, wherein the elastic deformation of the at least one part of the clamping element relative to its rest position in the mounted state is the elastic deformation of a pawl element formed on the clamping element relative to its rest position in the mounted state.

13. The secondary handguard mount according to claim 1, wherein the clamping element is fixedly formed on the upper receiver or the barrel mount of the firearm, and the abutment is fixedly formed on the handguard.

14. The secondary handguard mount according to claim 13, wherein the clamping element is integrally formed on the upper receiver or the barrel mount of the firearm.

15. The secondary handguard mount according to claim 1, wherein the clamping element is fixedly formed on the handguard and the abutment is fixedly formed on the upper receiver or the barrel mount of the firearm.

16. The secondary handguard mount according to claim 15, wherein the clamping element is integrally formed on the handguard.

17. The secondary handguard mount according to claim 1, wherein the clamping element is fixedly formed on the handguard;

the abutment is fixedly formed on the upper receiver or the barrel mount of the firearm;

the abutment has a pawl protrusion configured to at least partially contact the clamping element;

the clamping element is configured as an eyelet-shaped attachment element that accommodates the front takedown pin; and a pawl protrusion is formed on the upper receiver or the barrel mount.

18. The secondary handguard mount according to claim 17, wherein the eyelet-shaped attachment element defines an additional cavity on the side thereof facing the barrel mount for at least partially contacting or accommodating the abutment.

19. The secondary handguard mount according to claim 1, further comprising a second clamping element that is formed symmetrically relative to a weapon median plane relative to the clamping element.

20. The secondary handguard mount according to claim 1, wherein the clamping element includes a barrel clamp lever.

* * * * *